United States Patent [19]

Ando

[11] 4,336,317

[45] Jun. 22, 1982

[54] METHOD FOR FORMING IMAGES USING A PHOTOSENSITIVE SCREEN

[75] Inventor: Yujiro Ando, Yokohama, Japan

[73] Assignee: Canon Kabushiki Kaisha, Tokyo, Japan

[21] Appl. No.: 188,245

[22] Filed: Sep. 17, 1980

[30] Foreign Application Priority Data

Sep. 26, 1979 [JP] Japan ..... 54-123635

[51] Int. Cl.[3] ..... G03G 13/22; G03G 13/24

[52] U.S. Cl. ..... 430/53; 430/102; 430/120; 430/126; 355/35 C; 346/159

[58] Field of Search ..... 430/39, 53, 102, 120, 430/122, 126; 427/14.1; 346/159; 355/35 C

[56] References Cited

U.S. PATENT DOCUMENTS 3,392,642 7/1968 Germer ..... 430/120 X
3,986,872 10/1976 Giaimo ..... 430/122 X
4,038,665 7/1977 Neukermans ..... 430/120 X

FOREIGN PATENT DOCUMENTS 51-60528 5/1976 Japan .

OTHER PUBLICATIONS

Ullrich, "Magnetic Field Compensation in Touchdown Gap Variation", IBM Tech. Discl. Bull., vol. 1, No. 4, Apr. 1976, p. 13.

*Primary Examiner*—Roland E. Martin, Jr.
*Attorney, Agent, or Firm*—Fitzpatrick, Cella, Harper & Scinto

[57] ABSTRACT

A novel image forming method comprises the steps of providing a thin layer of magnetic developer particles on the surface of a developer supporting member, imagewise applying ions onto the thin layer in the presence of a magnetic field and imagewise transferring the developer particles onto the surface of another member.

7 Claims, 12 Drawing Figures

METHOD FOR FORMING IMAGES USING A PHOTOSENSITIVE SCREEN

BACKGROUND OF THE INVENTION

1. Field of the Invention

The present invention relates to a novel image forming method and more particularly to a method for forming images in which a magnetic developer is imagewise transferred onto a transfer material so as to form an image composed of the developer on the transfer material.

2. Description of the Prior Art

It is well known in the art to obtain an image by uniformly applying a developer (which is referred to also as toner) on a supporting surface and then selectively removing the developer. According to one of known processes to carry out this image forming method there is used a photoconductive toner. The photoconductive toner is uniformly dispersed on a surface, corona charging is carried out on the toner layer and then an imagewise exposure is conducted to selectively erase the electric charge. The photoconductive toner in the selected area is removed to form a desired image. This process is particularly suitable for forming images on a body having a large surface area. However, this process involves some disadvantages. The removed photoconductive toner can not be used repeatedly. A limitation is put on the number of repeating uses of the removed toner. Another problem is that practically useful toner having sufficient photoconductivity to carry out the method is difficult to manufacture.

To solve the above problems, we, the applicant of the present application have already proposed a novel image forming process which is the subject of Japanese patent application laid open No. 60,528/1976. According to the process proposed by the prior application insulating toner is used. The insulating toner is applied uniformly on a support member and then an ion stream is imagewise applied to the toner through ion stream controlling elements such as a photosensitive screen. The toner having charges imagewise modulated by the ion stream is transferred onto a recording material to obtain a desired image.

This prior process has advantages over the aforementioned process employing photoconductive toner. Since, in this process, a simple insulating toner is used as developer, the removed and recovered toner can be used repeatedly almost an infinite number of times. At the same time, the image developing step conventionally required for a common electrophotographic process is no longer necessary in this process. Therefore, high quality images can be obtained in a more stable manner and at a higher speed. Although the process has these remarkable advantages, it has been found that the process still involves some problems. When an imagewise ion stream is applied to the toner support member, a portion of the toner is undesirably stuck on the ion stream controlling element. This is one problem. Another problem concerns the toner application step on the support member. While the process makes the conventional developing step unnecessary, it involves a step of coating the support member with a thin layer of toner as the first step of the process. This coating of toner may be carried out employing any suitable method. However, according to the type of coating method then used, means for applying toner on the support member is required to have almost the same level of function as that required for conventional developing means.

SUMMARY OF THE INVENTION

Accordingly, it is an object of the invention to provide an image forming method which eliminates the problems mentioned above.

It is another object of the invention to provide an image forming method which produces images having less edge effect and which is excellent in gradation and sharpness in a simplified manner.

To attain the above objects according to the invention there is provided an image forming process which comprises the steps of providing on a support member a thin layer of magnetic developer particles, imagewise applying ions to the thin layer in the presence of a magnetic field and then imagewise transferring the developer particles from the support member to the surface of another member.

According to another aspect of the invention there is also provided an image forming process comprising the steps of providing a thin layer of magnetic developer particles on the surface of a developer particle supporting member having a magnetic field generating means comprising an assembly of N- and S-poles disposed closely to each other, applying imagewise ions to the thin layer in the presence of a magnetic field and then imagewise transferring the developer particles.

Other and further objects, features and advantages of the invention will appear more fully from the following description taken in connection with the accompanying drawings.

DESCRIPTION OF THE PREFERRED EMBODIMENTS

As previously mentioned, the image forming process according to the invention involves a step of applying an imagewise ion stream to a toner layer on a support member. This step is carried out generally by using a photosensitive screen of apertured board. In this connection it should be understood that there is no limitation regarding the type and structure of the photosensitive screen or apertured board used in the invention provided it has a great number of small openings and is able to form a latent image thereon. For example, those which are disclosed in Japanese Patent Publication No. 30320/1970 (corresponding to U.S. Ser. No. 452,095 filed April 30, 1965 and No. 492,988 filed Sept. 27, 1965), Japanese Patent Publication No. 39318/1971 (corresponding to U.S. Ser. No. 322,613 filed Nov. 14, 1963), Japanese Patent Publication No. 5063/1973 (corresponding to U.S. Ser. No. 709,578 filed Mar. 1, 1968 and No. 709,660 filed Mar. 1, 1968), Japanese Patent Laid-open No. 59840/1973 (corresponding to U.S. Ser. No. 197,877 filed Nov. 11, 1971), Japanese Patent Laid-open No. 42734/1973 (corresponding to German Patent Application No. P 2148001.3 filed Sept. 25, 1971), Japanese Patent Laid-open No. 13109/1972 (corresponding to U.S. Ser. No. 101,681 filed Dec. 28, 1970) and U.S. Pat. No. 3,689,935 may be used in the process of the invention without prejudice. Also, other methods making use of discharge phenomenon or ionization phenomenon may be used to carry out the step of applying an imagewise ion stream to a toner layer.

The invention will be hereinafter particularly described with reference to the accompanying drawings without limiting the scope of the invention.

FIG. 1 illustrates the principle of an image forming process according to the invention the steps of which are illustrated in succeeding figures wherein a photosensitive screen 3, composed of a photoconductive grid 1 and a photoconductive material 2, is used to form an electrostatic latent image 4, in accordance with Carlson's Method or another known method. As the photosensitive screen 3 there may be used also such photosensitive screen coated with an insulating layer. In this case, an electrostatic latent image can be formed employing, for example, Canon NP system which is disclosed in U.S. Pat. No. 3,666,363.

Figure 1A:
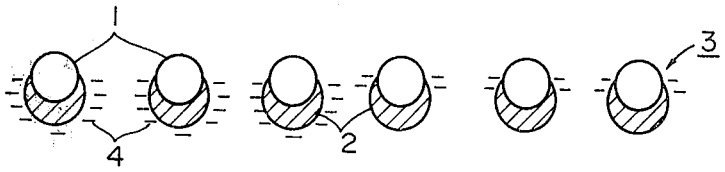
FIGS. 1A through 1D are illustrative views of the respective steps of the image forming process according to the invention.
Figure 1B:
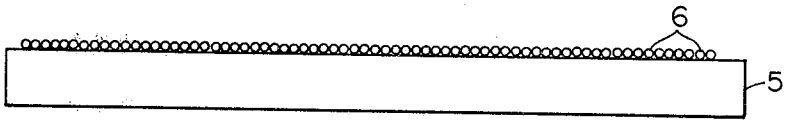

At the next step shown in FIG. 1B, a magnetic insulating toner 6 is uniformly spread on a toner support member 5. Application of the toner on the support member may be carried out in various manners. For example, the magnetic toner may be simply scattered on the support member to form a uniform layer of toner. Also, corona discharge may be used to scatter the toner electrostatically on the support member. While application of bias voltage is conducted, conventional development may be carried out. Since the toner is magnetic, its application to the support member may be advantageously carried out by coating with a magnetic field.

Figure 1C:
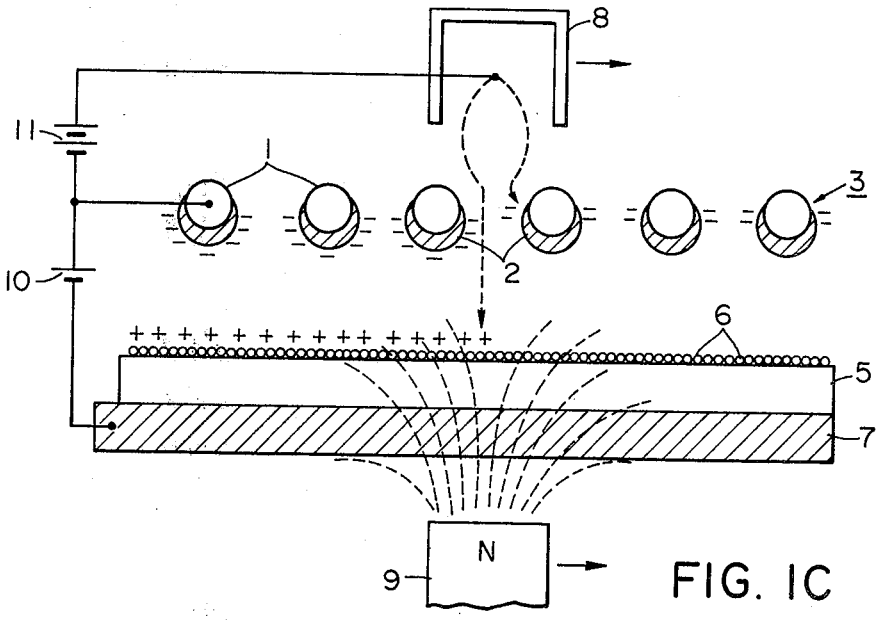

At the step shown in FIG. 1C, the photosensitive screen 3 having an electrostatic latent image formed thereon and the toner support member 5 having a layer of toner 6 applied thereon are brought into a predetermined positional relation as shown in the drawing. Also, in the manner shown in FIG. 1C there are disposed an electrode 7 and corona discharger 8 generating a stream of corona ions (charged particles) which runs toward the toner layer 6 passing through the photosensitive screen 3 having an electrostatic latent image. The corona ions are modulated by the screen 3 and then reach the toner layer 6 to which they adhere imagewise. In the shown embodiment, the corona ions imagewise applied to the toner 6 are positive corona ions. In this case, to obtain images without fogging it is preferred that the tone 6 be negatively precharged. 11 is a voltage source for corona discharging and 10 is a bias voltage which is applied between the screen 3 and support member 5 to direct the ions toward the support member. When the toner particles 6 are those negatively charged, the particles are apt to fly toward the screen 3 under the influence of an electric field generated by the bias voltage 10. The toner particles jumping to the screen 3 make the latter dirty. To solve the problem there is provided a magnet 9 whose magnetic field is suggested by broken lines in FIG. 1C. Since the toner 6 is under the action of a force working in the direction in which the magnetic field gradually intensifies, no toner particle will fly toward the screen 3.

Figure 1D:
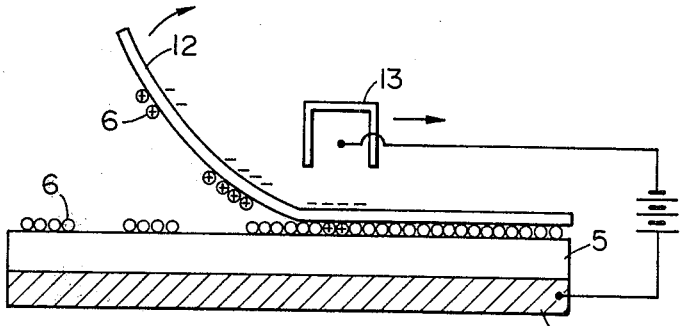

At the last step shown in FIG. 1D, the toner 6 to which corona ions were imagewise applied at the previous step is transferred onto a recording material 12 with the aid of a corona discharge 13. Thus, a visual image is obtained. At this step of transferring, the use of a magnetic field has an effect to prevent fogging and therefore no disadvantage of fogging is produced even when there is used such toner 6 which has not been precharged with the polarity opposite to that of the corona discharger 13. Use of non-charged toner as the toner 6 on the support 5 will further reduce the possibility that the screen 3 may be made dirty by toner particles at the step of ion application shown in FIG. 1C.

To obtain a desired final image, the visual image formed at the step 1D is fixed by using fixing means known per se or it is transferred onto another recording material in a manner known per se.

While in the embodiment shown in FIG. 1 the invention has been described in connection with an electrophotographic method, the invention is also applicable to electrostatic printing methods. In this case, the photosensitive screen 3 is replaced by an apertured board to which electrical signals are fed and another slight change is required. In all other respects, the electrostatic printing process according to the invention can be carried out in the same manner as above. No essential change is required.

Figure 2:
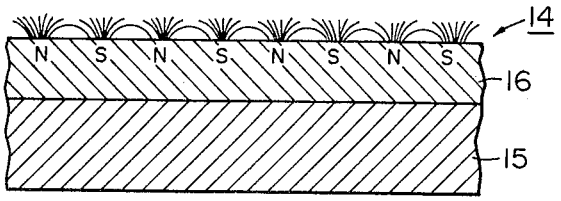
FIG. 2 schematically shows an example of the toner support member used in the invention.
Figure 3:
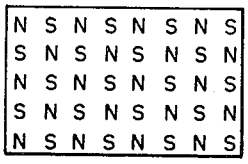
FIGS. 3 through 6 schematically show various examples of magnetic pole distribution on the toner support member.

FIG. 2 shows a form of the toner support member used in the invention. The support member 14 comprises a substrate 15 and an upper layer of magnetic substance 16.

As seen from the drawing, the surface of the support member 14 has a number of N- and S-poles alternately and closely arranged. As the magnetic substance 16 there may be used various permanent magnet materials and magnetic recording materials including ferro-magnetic metals such as Fe, Co and Ni and alloys thereof. Various ferrites also may be used. The layer of magnetic substance 16 can be formed by using any suitable known method such as electro-plating, chemical plating, sintering or coating. To form the magnetic poles, the support member, after molding, is magnetized employing a known technique. Alternatively, the substrate is coated with magnetic substance having a particle size in the range of 0.05 to 1.0 mm premagnetized employing a suitable binder. In the latter case, the poles on the toner support member are not set in array. But, they can perform the same function as the poles set in array do, provided that the magnetic substance particles are uniformly dispersed.

Preferably, the magnetic substance 16 has a resistance value less than $10^{12}$ Ω.cm. If the magnetic substance has a higher resistance, then a thin conductive layer has to be formed on the surface to reduce the resistance of magnetic substance 16 up to the desirable level. Since the magnetic substance layer 16 is intended to serve also as an electrode opposite to the electric charge on the toner aiming at facilitating the charging of toner and/or as a counter electrode at the time of an imagewise ion stream being applied to the toner layer, the magnetic substance 16 is desired to have a low resistance. Therefore, when the toner support member 14 has a very thin magnetic substance layer 16 formed by using a magnetic material which is high in magnetization density and large in magnetic reluctance, the support member can be used as a counter electrode.

In the toner support member 14 having a large number of different poles (S- and N-poles) arranged alternatively and closely to each other on the surface of the member, minute magnetic field is produced in a dispersion state on the surface, and as a result, the magnetic toner particle adheres only to the area on which the minute magnetic field thus produced has influence. This makes it possible to easily form a thin layer of toner.

Figure 4:
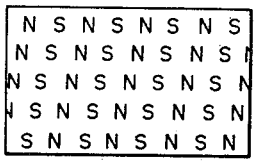
Figure 5:
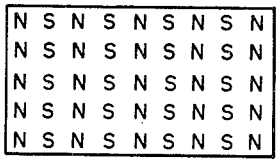
Figure 6:
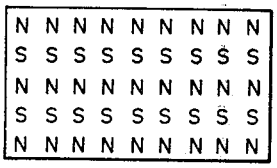

Various patterns of magnetic poles on the toner support member 14 useful for the above purpose are exemplarily shown in FIGS. 3 to 6. In the pattern shown in FIG. 3, alternate poles of N and S are arranged in lines normal to the moving direction of the support member 14. FIG. 4 shows a modification of the FIG. 3 pattern in which the lines of poles are regularly shifted from the normal direction. In the patterns shown in FIGS. 5 and 6, the same poles are arranged on the same line, and more particularly in FIG. 5, N-pole lines alternate with S-pole lines and in the pattern shown in FIG. 6 the alternate lines of N and S are turned by 90° relative to the FIG. 5 arrangement. Alignment of the poles in row and line is not absolutely necessary. The magnetic poles may be arranged irregularly on the surface of the support member 4 so long as a uniform dispersion of poles is assured as mentioned above.

The thickness of a layer formed by the toner adhered on the support member is inversely proportional to the distance between the magnetic poles. Although the layer thickness depends also upon the magnetic intensity of the poles, the dependency is negligibly small. Therefore, the thickness of toner layer to be formed on the support member is substantially determined by the distance between poles. In the process according to the invention it is required to obtain a thin and uniform layer of toner. It has been found that good results can be obtained when the distance between poles is set to a value in the range of from 0.05 to 1.0 mm, and preferably from 0.05 to 0.5 mm.

As to the type of toner used in the invention there is no particular limitation provided that it is a magnetic insulating toner. All of the known magnetic insulating toners and similar toners can be used in the invention. A typical example of the toner useful in the invention is a toner that is composed of resin, magnetic substance fine particle and coloring matter. Examples of useful resin include epoxy resin, alkyd resin, polyamide resin, polyethylene resin, polyvinyl acetate resin, polyacrylic ester resin and other known copolymer resins. As the fine particle of magnetic substance there may be used that of oxides such as various ferrites, tri-iron tetroxide and iron sesquioxide, various simple substances such as iron, nickel and manganese and also that of their alloys. These magnetic substance particles adhere onto the toner support member without any need of premagnetization. It is preferable that the particle be low in coercive force. Preferred particles have a particle size in the range of from 0.05 to 10$\mu$. Examples of coloring matter are carbon black, Cyanine black and Aniline Black. Color is never limited to black only. Other coloring matters such as Crystal Violet, Rhodamine B and Malachite Green also may be used.

Composition and structure of toner itself constitute no essential part of the present invention and therefore need not be further described.

Figure 7:
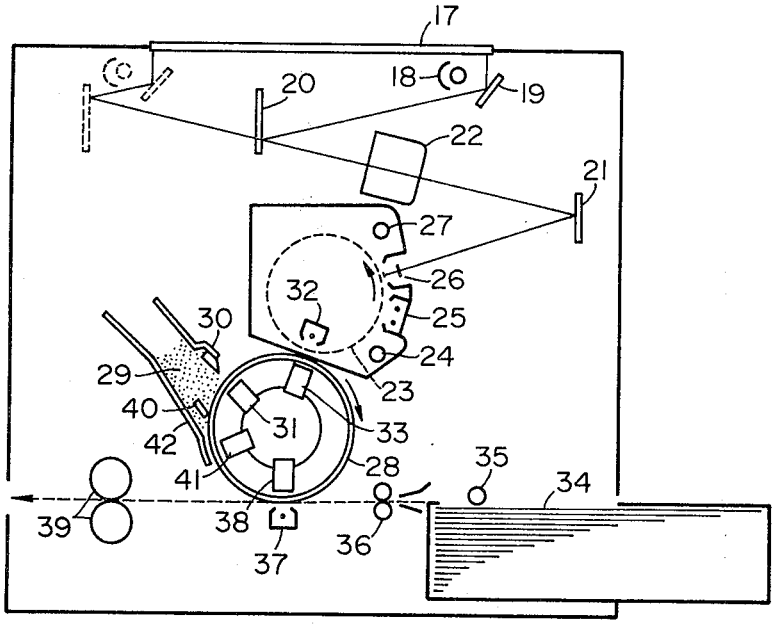
FIGS. 7 and 8 are schematic sectional views of the apparatus in which the present invention is embodied.

FIG. 7 schematically shows a copying machine in which the present invention is embodied.

In FIG. 7 an image on a original table 17 is focused on a photosensitive screen drum 23 through an optical system constituted of lamp 18, mirrors 19, 20 and 21 and less 22 in the manner known per se. The photosensitive screen drum 23 is of a known type which has a photoconductive layer and an insulating layer formed on an electrically conductive screen structure by employing a spray coating technique or other suitable known method. Further details of such type of photosensitive screen drum is disclosed, for example, in B.P. No. 1,480,841 (corresponding to Japanese Patent Laid-open No. 19455/1975). To form an electrostatic latent image on the drum 23 there are provided a pre-exposure lamp 24, primary charger 25, AC corona discharger 26 and whole surface exposure lamp 27. Formation of the electrostatic latent image on the photosensitive screen drum is carried out in a manner known per se while the optical system is being moved. The photosensitive drum 23 is rotated at a relatively low peripheral speed in the order of 10–20 cm/sec. during the formation of electrostatic latent image. After an electrostatic latent image has once been formed on the photosensitive screen, the one and same latent image can be used repeatedly to modulate ion stream a large number of times, for example several ten times to hundred times. Therefore, the subsequent process can be carried out at a higher speed while keeping the optical system, primary charger, AC discharger etc. out of operation. For example, an operational speed in the range of 30 to 105 cm/sec. or more can be used.

Designated by 28 is a toner supporting drum which is composed of a metallic drum such as an aluminum drum covered with a hard film formed by anodic oxidation or other suitable technique. A powder ink that is magnetic toner 29 is applied to the circumferential surface of the toner supporting drum 28. To form a thin and uniform layer of toner on the supporting drum there are provided a blade 30 and a magnet 31. The blade is made of magnetic material and disposed close to the drum surface. The magnet is disposed stationary within the drum.

A corona discharger 32 generates a corona ion stream flowing toward the toner layer on the supporting drum 28. At this time, the ion stream is modulated in accordance with the electrostatic latent image formed on the photosensitive screen drum 23 so that the level of electric charge on the magnetic toner 29 is imagewise changed. A magnet 33 serves to prevent the toner from jumping toward the photosensitive screen at this time.

In synchronism with the toner image, a sheet of recording paper 34 is fed to the drum by means of a pickup roller 35 and a pair of registering rollers 36. The recording paper is moved along the path indicated by a broken line in the drawing. Under the action of corona discharger 37 the toner is imagewise transferred onto the recording paper 34. At this time, a magnet 38 serves to prevent any toner causative of fogging from transferring from the drum surface to the recording paper. The toner image on the recording paper 34 is fixed by a fixing device 39 which may be of heating and pressing roller type. After fixing, the recording paper is discharged from the machine. Toner remaining on the supporting drum 28 is removed by a scraping blade 40 and reused to form a layer of toner on the drum for the next cycle of operation. To prevent the toner from falling down through the gap between the toner container 42 and the supporting drum 28 there is provided a magnet 41 within the drum. The above copy making process is repeated a desired number of times. In this manner, a large number of copies having high quality can be made in a short time using a simple apparatus.

Magnets 31, 38 and 41 are not always necessary and only one or two of them may be provided. Also, various combinations or magnetic poles may be selected for these magnets.

Figure 8:
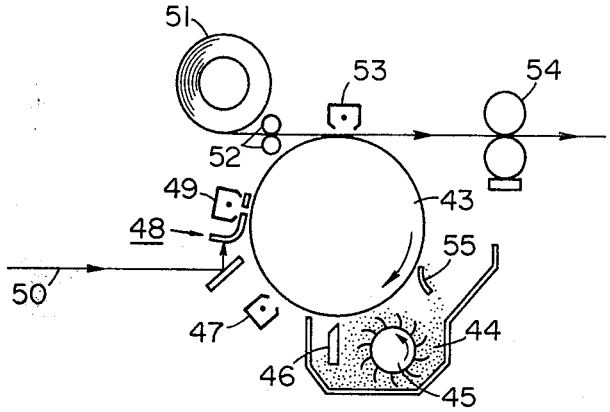

FIG. 8 schematically shows a laser recording apparatus in which the present invention is embodied.

Designated by 43 is a magnetic toner supporting drum made of metal and having on its surface a thin magnetic film. The magnetic film is finely magnetized so as to form the pattern shown in FIG. 3 which is suitable for holding thereon the toner in the form of a layer of several $\mu \times 10'$ microns in thickness. The toner 44 is applied to the toner supporting drum 43 by a scooping roller 45 and a thin and uniform layer of toner is formed on the drum by the aid of a blade 46 disposed slightly spaced from the surface of the drum 43. The blade 46 may be of magnetic material. Also, it may be shaped as a cylinder which can be driven to rotate in the same direction as the drum 43 or the opposite direction to the drum.

The magnetic toner 44 applied onto the supporting drum 43 is uniformly charged by a corona discharger 47 and then receives ions from a corona discharger 49 passing through an ion stream modulator 48 which imagewise modulates the ion stream flowing toward the drum 43.

Like the case of the previous embodiment, the fine magnetic field existing on the drum 43 according to the invention retains the toner on the drum. This prevents the modulator 48 from being made dirty by toner.

Figure 9:
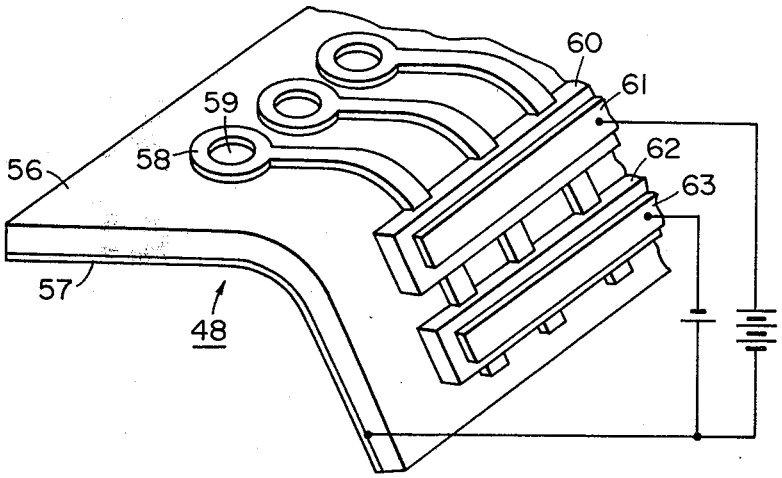
FIG. 9 is a partly enlarged perspective view of the ion stream modulator shown in FIG. 8.

The ion stream modulator 48 is driven by a laser beam 50 which is modulated, for example, by a super sonic modulating element and is scanned by a rotary mirror. The structure of the modulator 48 is shown in FIG. 9 in detail as an enlarged view. To effectively irradiate the photoconductive element of ion stream modulator 48 it is desirable that the direction in which the laser beam 50 expands lie within the plane of the drawing.

A recording member 51 is fed to the drum 43 by a pair of rollers 52 and the toner 44 is imagewise transferred onto the recording member from the drum surface under the action of a corona discharger 53. The toner image on the recording member 51 is then fixed by a pressure fixing device 54. After transferring, the toner remaining on the drum 43 is removed by a metal blade 55 to prevent formation of a residual image.

Referring now to FIG. 9, the ion stream modulator 48 comprises a uniform electrode 57, an insulating member 56 and signal electrodes 58. One end of each of the signal electrodes 58 is so formed as to enclose each opening 59 which passes through the uniform electrode 57 via the insulating member 56. At the other end of the signal electrode 48 there are formed a photoconductive element 60 with a transparent electrode 61 and a resistor 62 with an electrode 63. The resistance value of the resistor 62 is so selected as to be lower than the dark resistance of the photoconductive element 60 and higher than the light resistance of the same. All of the photoconductive element 60, transparent electrode 61, resistor 62 and electrode 63 may be formed, for example, by coating.

Of many signal electrodes 58 only the one which is receiving a photo signal is able to transmit corona ions. To this end, when the polarity of corona ions to be modulated is negative, a voltage which is positive relative to that of the uniform electrode 57 is applied to the transparent electrode 61 and another voltage which is negative relative to that of the uniform electrode 57 is applied to the electrode 63. As a concrete example there are applied −3000 V to the uniform electrode 57, −2700 V to the transparent electrode 61 and −3100 V to the electrode 63. By doing so, the signal electrode lying at the area irradiated by light gets a potential near the potential of the transparent electrode 61 and therefore it allows corona ions to pass through. On the contrary, at the remaining area not irradiated by light, the potential of the signal electrode remains at a level near the potential of the electrode 63 and therefore it blocks corona ions. By suitably selecting the combination of applied voltages the above state can be easily inverted.

While the ion stream modulator has been shown to be of photo driven type, another type of ion stream modulator also can be used. For example, there may be used such type of conventional ion stream modulator in which signal voltages are directly applied to the respective signal electrodes. Obviously many other modifications and variations are possible in light of the above teachings. It is therefore understood that within the scope of the appended claims, the invention may be practiced otherwise than as specifically described.

As readily understood from the foregoing, the present invention has many advantages over the prior art.

In the apparatus according to prior art, the ion stream modulating element is often made dirty by toner when an imagewise ion stream is applied to the toner layer. This results in reduction of the function of the ion stream modulator. According to the present invention the problem is solved by using a magnetic field. Use of a toner supporting member having a minute magnetic field in accordance with the invention not only brings forth the above effect but also makes it easy to uniformly coat the toner supporting member with toner.

What I claim is:

1. A method for forming an image, wherein an ion stream is applied to a control means which emits a controlled stream of ions to form an imagewise charge pattern in a layer of developer particles, which method comprises the steps of coating a uniform layer of magnetic electrically-insulating developer particles onto one surface of a developer supporting member, applying the controlled stream of ions to said uniform layer of developer particles to form the charge pattern in said layer while generating a magnetic field at an opposed surface of said developer particle supporting member when said layer is at the position for forming the charge pattern, and placing a transfer member onto said developer layer having the charge pattern to transfer the developer particles onto said transfer member in accordance with the charge pattern.

2. A method for forming an image according to claim 1, further comprising, prior to the step of applying the controlled ion stream to said uniform layer of developer particles, a step of uniformly charging said layer with an ion stream having the polarity opposite to that of the ion stream for forming the charge pattern.

3. A method for forming an image according to claim 1, in which the transferring of the developer particles to said transfer member in accordance with the charge pattern is carried out in the presence of a magnetic field generated by a magnetic field generating means disposed at the opposite side of said transfer member with respect to said developer particle supporting member.

4. A method for forming an image, wherein an ion stream is applied to a control means which emits a controlled stream of ions to form an imagewise charge pattern in a layer of developer particles, which method comprises the steps of coating a uniform layer of magnetic electrically-insulating developer particles onto one surface of a developer supporting member which carries means of providing a magnetic field generated by an assembly of N- and S-poles disposed at intervals of 1 mm or less, applying said controlled ion stream to said uniform layer of developer particles to form the charge pattern in said layer under the influence of said magnetic field, and placing a transfer member on said layer having said charge pattern to transfer said developer particles onto said transfer member in accordance with said charge pattern.

5. A method for forming an image according to claim 4, in which said poles are disposed at intervals of from 0.05 to 0.5 mm.

6. A method for froming an image according to claim 4, in which said developer particle supporting member has an electric resistance of $10^{12}\Omega$.cm or below.

7. A method for forming an image according to claim 4, further comprising, prior to the step of applying the controlled ion stream to said uniform layer of developer particles, a step of uniformly charging said layer by use of an ion stream having a polarity opposite to that of the ions for forming said charge pattern.

* * * * *